US012439984B2

(12) United States Patent
Tatsuno et al.

(10) Patent No.: US 12,439,984 B2
(45) Date of Patent: Oct. 14, 2025

(54) COLD-WEATHER PROTECTION GEAR HAVING BATTING

(71) Applicant: MONTBELL CO., LTD., Osaka (JP)

(72) Inventors: Isamu Tatsuno, Osaka (JP); Fumiaki Masaki, Osaka (JP); Takeshi Tatsuno, Osaka (JP); Hideo Takatori, Osaka (JP); Tetsuji Kasumi, Osaska (JP)

(73) Assignee: MONTBELL CO., LTD., Osaka (JP)

( * ) Notice: Subject to any disclaimer, the term of this patent is extended or adjusted under 35 U.S.C. 154(b) by 449 days.

(21) Appl. No.: 17/425,683

(22) PCT Filed: Jan. 20, 2020

(86) PCT No.: PCT/JP2020/001746
§ 371 (c)(1),
(2) Date: Jul. 23, 2021

(87) PCT Pub. No.: WO2020/153305
PCT Pub. Date: Jul. 30, 2020

(65) Prior Publication Data

US 2022/0183412 A1 Jun. 16, 2022

(30) Foreign Application Priority Data

Jan. 24, 2019 (JP) ..... 2019-009991

(51) Int. Cl.
*A41D 31/06* (2019.01)
*A41D 31/10* (2019.01)
*A47G 9/08* (2006.01)

(52) U.S. Cl.
CPC ..... *A41D 31/065* (2019.02); *A41D 31/10* (2019.02); *A47G 9/08* (2013.01); *A41D 2400/10* (2013.01)

(58) Field of Classification Search
CPC .. A41D 31/065; A41D 31/10; A41D 2400/10; A41D 3/00; A47G 9/08; A47G 9/086; A47G 9/06

(Continued)

(56) References Cited

U.S. PATENT DOCUMENTS 3,032,457 A * 5/1962 Sarkissian ..... D04D 3/00 156/271
5,062,168 A * 11/1991 Kocib ..... A41B 13/06 5/413 R (Continued)

FOREIGN PATENT DOCUMENTS

JP S56-156817 U 11/1981
JP 2000-070098 A 3/2000

(Continued)

*Primary Examiner* — Amber R Anderson
*Assistant Examiner* — Luke Hall
(74) *Attorney, Agent, or Firm* — Studebaker Brackett PLLC

(57) ABSTRACT

Cold-weather protection gear is provided which includes a lining that covers a user; a surface cloth that covers the lining; and batting enclosed between the lining and the surface cloth. Linear members located between the lining and the surface cloth extend in a first direction while meandering, and are aligned with each other at an interval in a second direction crossing the first direction. Each of the linear members includes at least one core strand extending in the first direction; and a plurality of effect strands extending from each of the core strands and interlacing with the batting such that the batting is held in place relative to the linear members.

10 Claims, 4 Drawing Sheets

(58) Field of Classification Search
USPC ..... 5/413 R
See application file for complete search history.

(56) References Cited

U.S. PATENT DOCUMENTS

| | | | | |
|---|---|---|---|---|
| 5,110,383 | A * | 5/1992 | Kramer | A47G 9/086 5/413 R |
| 6,216,497 | B1 * | 4/2001 | Miyata | A41B 17/00 66/202 |
| 6,341,384 | B1 * | 1/2002 | Hayes | A62B 17/003 2/81 |
| 2004/0175532 | A1 * | 9/2004 | Rainbolt | B32B 5/26 442/268 |
| 2010/0138977 | A1 * | 6/2010 | Lin | A41H 43/04 156/182 |
| 2010/0256716 | A1 * | 10/2010 | Haislip | A47G 9/086 5/413 R |
| 2015/0020309 | A1 * | 1/2015 | Pitchforth | A47G 9/086 5/413 AM |
| 2015/0038040 | A1 * | 2/2015 | Gabbay | D03D 15/33 442/308 |
| 2016/0340814 | A1 * | 11/2016 | Ridley | B32B 7/05 |
| 2016/0374408 | A1 * | 12/2016 | Seo | B32B 7/12 2/93 |
| 2017/0042265 | A1 * | 2/2017 | Goussev | A41D 20/00 |
| 2017/0105556 | A1 * | 4/2017 | Tarpey | A47G 9/086 |
| 2017/0172240 | A1 * | 6/2017 | Massey | B32B 5/26 |
| 2018/0116317 | A1 * | 5/2018 | Inoue | A41D 31/02 |
| 2020/0345160 | A1 * | 11/2020 | Iriarte Tineo | A45F 3/52 |

FOREIGN PATENT DOCUMENTS

| | | | | |
|---|---|---|---|---|
| JP | 2016026528 | A * | 2/2016 | D02G 3/34 |
| JP | 2016027215 | A * | 2/2016 | D02G 3/34 |
| JP | 2016-211107 | A | 12/2016 | |
| JP | 2018-080423 | A | 5/2018 | |
| JP | 2018080423 | * | 5/2018 | A41D 31/00 |

* cited by examiner

1

COLD-WEATHER PROTECTION GEAR HAVING BATTING

TECHNICAL FIELD

The present invention relates to a cold-weather protection gear having batting filled between a lining and a surface cloth.

BACKGROUND ART

A cold-weather protection gear such as a sleeping bag, a down jacket and the like has a structure in which batting is filled between a lining and a surface cloth. Warmness of the cold-weather protection gear having such a structure depends on a thickness of the batting which creates an immovable air layer. If the batting leans, heat insulation is lowered at a portion where a thickness is small. It is known, for example, that a space in which the padding is to be filled, between cloths is divided into a plurality of air chambers by, for instance, sewing the lining and the surface cloth together (quilting), and by sewing a cloth piece which joins the lining and the surface cloth as a partition so that the batting does not lean in the sleeping bag.

Although the leaning of the batting can be prevented, the quilting brings the lining and the surface cloth closer to each other, and loft (bulk) collapses, hence, heat insulation of the sleeping bag is lowered. Addition of the partition makes the sleeping bag heavier. Since processes, such as sewing the partition, attaching a waterproof seam tape to a seam, and filing the batting in plural times, increase, a manufacturing process becomes laborious for workers. Thus, a sleeping bag is proposed in which a porous non-woven cloth is superposed between the lining and the surface cloth so that the batting is frictionally locked by the non-woven cloth (see Patent Documents 1 and 2, for example).

CITATION LIST

Patent Document

Patent Document 1: Patent Publication JP-A-2000-70098
Patent Document 2: Patent Publication JP-A-2018-80423

SUMMARY

Technical Problem

In a non-woven cloth, pores and fluffs in the surface are too small and thus, force thereof for interlacing with and holding the batting is weak. With the constitution described in the Patent Documents 1 and 2, leaning of the batting cannot be sufficiently prevented. In addition, when lined with the non-woven cloth, the cloth becomes hard. As a result, the loft becomes smaller, and the heat insulation of the sleeping bag is lowered. Cushioning properties of the sleeping bag are also lost. Thus, an object of the present invention is to provide a cold-weather protection gear which can prevent leaning of the batting, can be stored in a compact manner as compared with a case where the non-woven cloth is superposed, is excellent in heat insulation and in feeling on the skin, and is also excellent in productivity.

Solution to Problem

A cold-weather protection gear having batting according to a mode of the present invention includes a lining that covers a user, a surface cloth that covers the lining, a batting enclosed between the lining and the surface cloth, and a plurality of first linear members. The plurality of first linear members are located between the lining and the surface cloth, and aligned at an interval in a second direction, and moreover extend in a first direction crossing the second direction. Each of the first linear members includes at least one first core strand extending in the first direction and a plurality of first effect strands extending from each of the first core strands to the periphery of the first core strands and interlacing with the batting.

According to this mode, the batting can be held by the first effect strands extending from each of the first core strands to the periphery thereof so as to prevent leaning of the batting. Since a portion where the thickness of the batting is small is hardly generated, heat insulation of the cold-weather prevention gear is excellent. Even if the first core strands are aligned, the cloth is light-weighted and hardly becomes stiff as compared with a case where the non-woven cloth is superposed. Since cushioning properties of the cloths are not lost, the cold-weather protection gear with excellent heat insulation and excellent feeling on the skin can be provided. It can be stored in a compact manner as compared with the case where the non-woven cloth is superposed. Since there is no need to sew a partition or to subdivide to fill the batting between each of the partitions, productivity of the cold-weather protection gear is excellent.

In the aforementioned mode, both end portions of each of the first core strands may be fixed to the lining or the surface cloth.

According to this mode, since each of the first core strands is fixed and is not moved, the batting, held by the first effect strands and extending from the first core strands, is not moved easily. Hence, the leaning of the batting can be prevented more reliably. At the both end portions, the first core strand can be fixed only at two points in an extended state. Since the number of seams can be minimized, the cold-weather protection gear with excellent feeling on the skin can be constituted. The first core strand may be fixed at three points or more.

In the aforementioned mode, a plurality of second linear members may be further provided. The plurality of second linear members are located between the lining and the surface cloth, are aligned at an interval in the first direction, and extend in the second direction. Each of the second linear members includes at least one second core strand extending in the second direction and a plurality of second effect strands extending from each of the second core strands to the periphery of the second core strands and interlacing with the batting.

According to this mode, the first and second linear members are extended in a lattice state. Since the batting can be held by the second linear members in addition to the first linear members, the leaning of the batting can be prevented more reliably.

In the aforementioned mode, the surface cloth may be a waterproof cloth.

In this mode, since the leaning of the batting is prevented by the first effect strands, seams for the partition or the quilting can be omitted. When the partition is to be sewn into the waterproof cloth, the seams need to be closed by a seam tape so that water does not intrude through the seams. Since there is no need to attach the seam tape in this mode, it is particularly suitable for combination with the waterproof cloth. A weight of the cold-weather protection gear can be reduced by omitting the seam tape.

Advantageous Effects of Invention

According to the present invention, the cold-weather protection gear which can prevent leaning of the batting, can be stored in a compact manner as compared with the case where the non-woven cloths are superposed, is excellent in heat insulation and feeling on the skin, and is also excellent in productivity can be provided.

DESCRIPTION OF EMBODIMENTS

Figure 1:
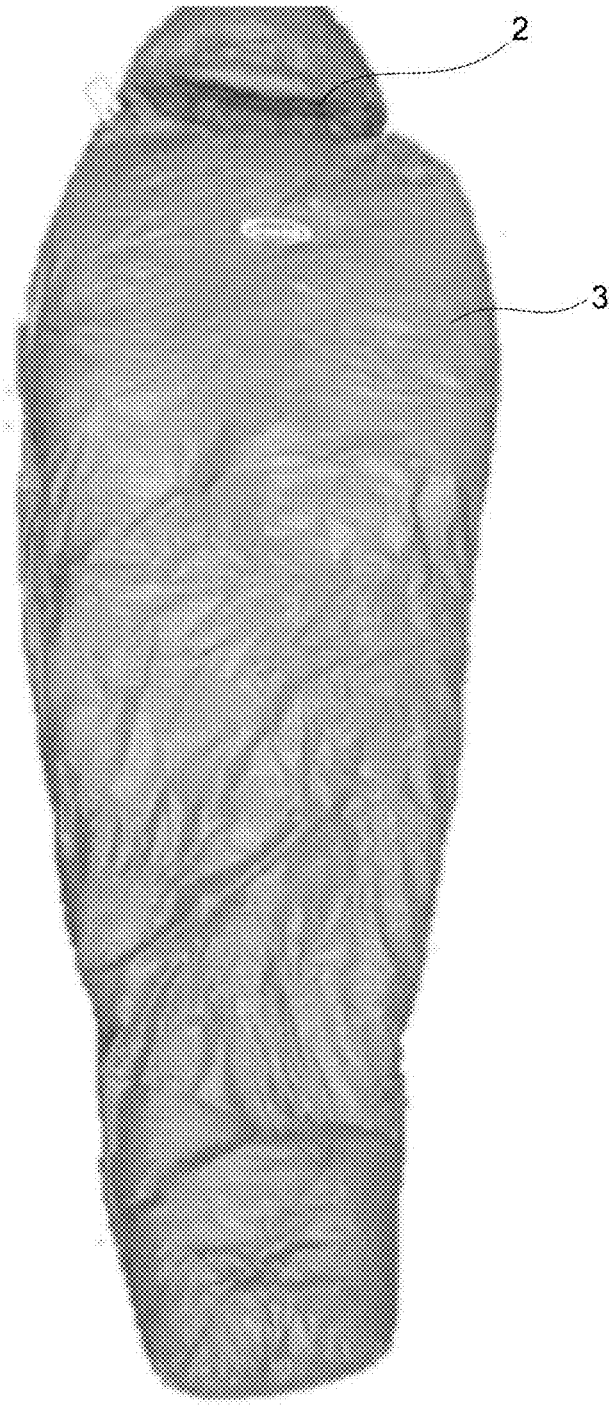
FIG. 1 is a view illustrating a sleeping bag of an embodiment of the present invention.

By referring to the attached drawings, a preferable embodiment of the present invention will be explained. It is to be noted that, in each figure, those given the same referential signs have the same or similar constitutions. In FIGS. 1 to 4, a sleeping bag 1 filled with batting 4 is disclosed as an example of a cold-weather protection gear having batting. However, the cold-weather protection gear having batting is not limited to the sleeping bag 1 but may be bedding having batting such as Futon and the like or may be clothes having batting such as a down jacket, a glove and the like.

The cold-weather protection gear (the sleeping bag 1, for example) of an embodiment of the present invention has a feature of preventing leaning of the batting 4 such as down or the like by chenille yarns 10 and 20 aligned in parallel or in a lattice state. There has been a case in which the chenille yarns are used for the cold-weather protection gear such as a sleeping bag or the like, but it is limited to a use as a batting with an attention paid to heat insulation and restorability (see Patent Publication JP-A-2014-226336 and Patent Publication JP-A-2012-67430, for example).

The cold-weather protection gear of the embodiment of the present invention uses the chenille yarns 10 and 20 as constitution for preventing leaning of the batting 4. The chenille yarns 10 and 20 can be made lighter than the partition which is conventional constitution used for the purpose of preventing the leaning of the batting 4 and moreover, they can store air. By using the chenille yarns 10 and 20 in place of the partition, the cold-weather protection gear having batting which is light-weighted and has a large loft can be provided. Since there is no need to superpose a non-woven cloth on the cloth, the cold-weather protection gear having batting in which the lining 2 and the surface cloth 3 are soft and excellent in feeling on the skin can be provided. Hereinafter, each constitution will be explained in detail by referring to FIGS. 1 to 4.

Figure 2:
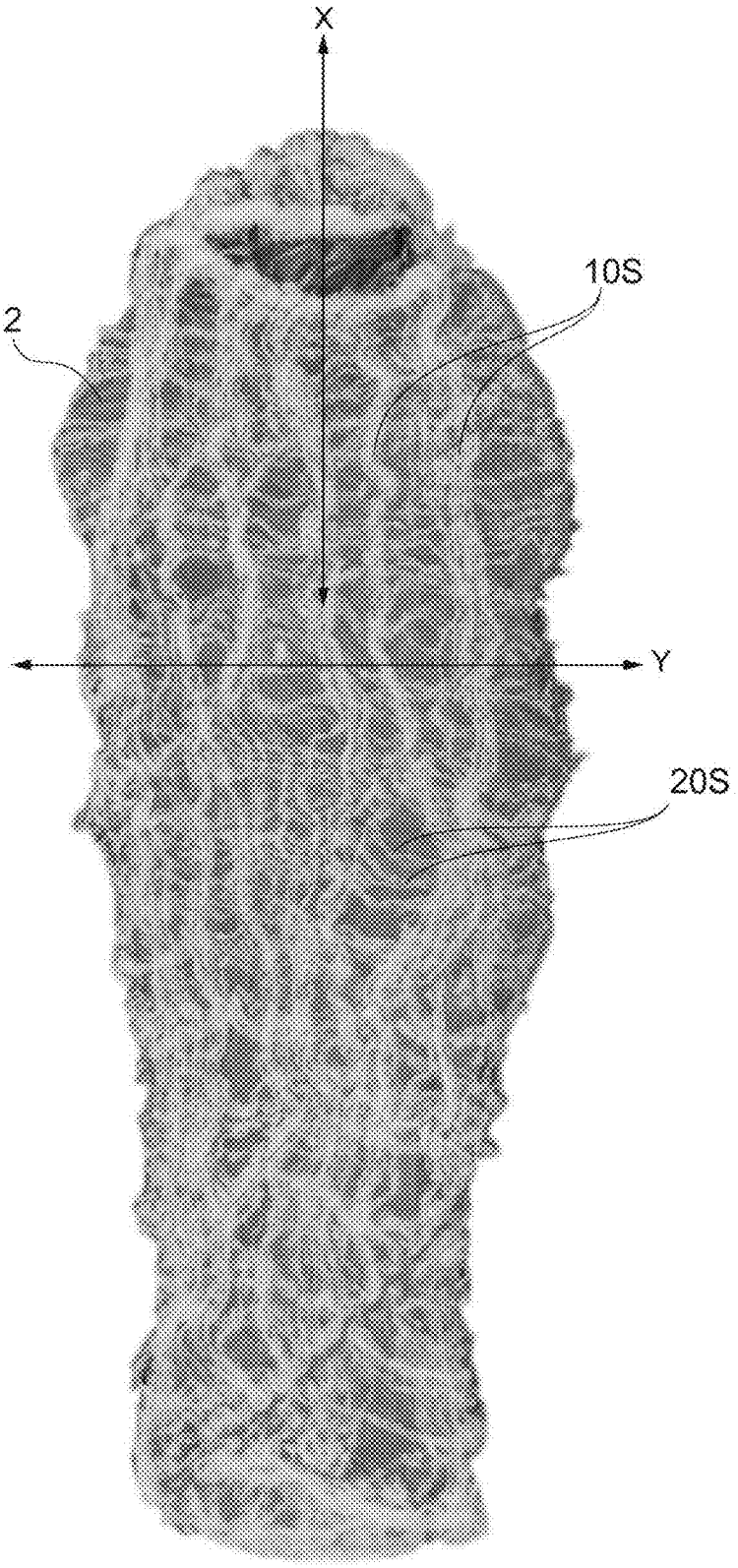
FIG. 2 is a view illustrating a state where a surface cloth and batting are removed from the sleeping bag illustrated in FIG. 1 and chenille yarns are exposed.

FIG. 1 is a view illustrating the sleeping bag 1 of the embodiment of the present invention, and FIG. 2 is a view illustrating a state in which the surface cloth 3 and the batting 4 are removed from the sleeping bag 1 illustrated in FIG. 1, and the chenille yarns 10 and 20 are exposed. In the illustrated example, a mummy type sleeping bag (German: Schlafsack, English: sleeping bag) is disclosed. However, an outer appearance of the sleeping bag 1 is not limited to the mummy type but may be an envelope type or any other types.

Figure 3:
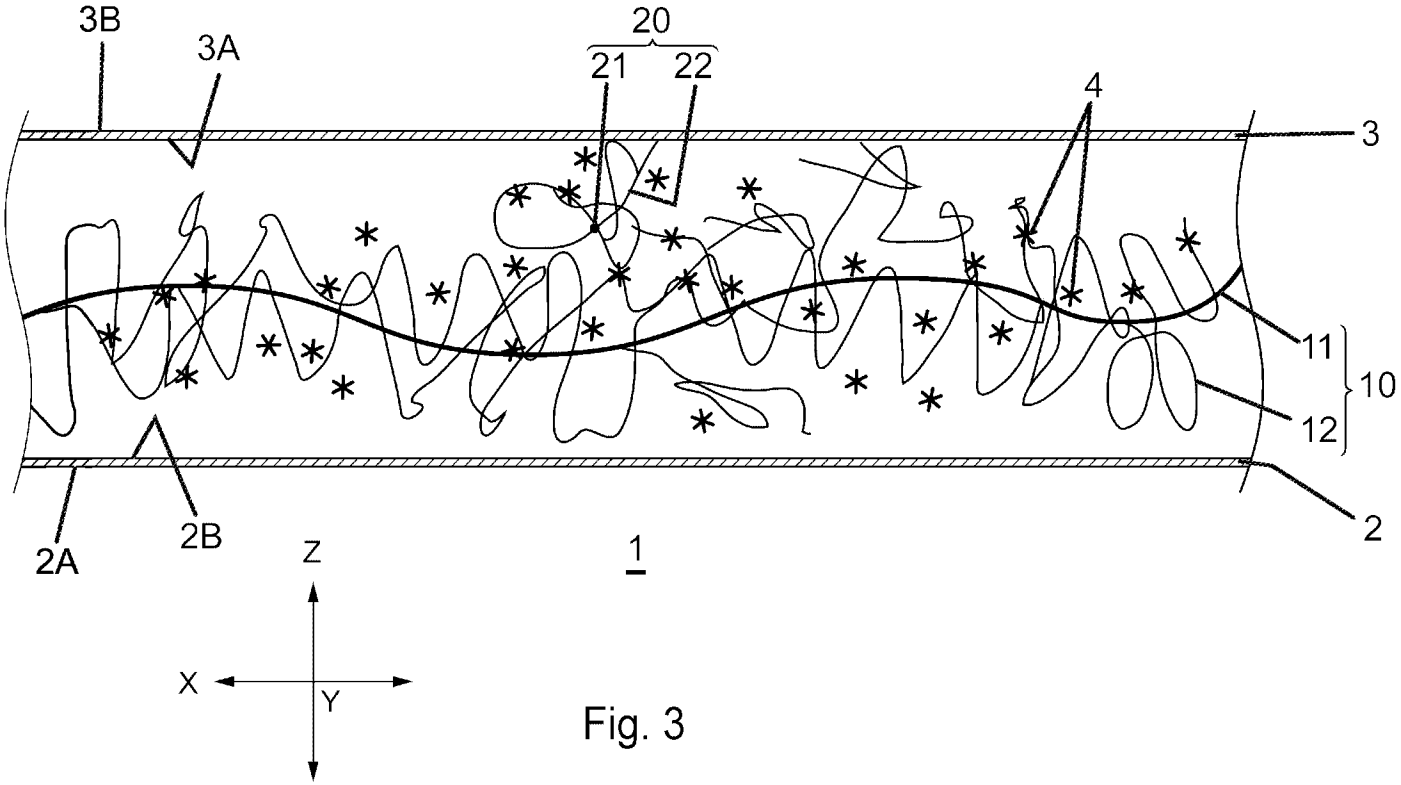
FIG. 3 is a sectional diagram schematically illustrating an example of an internal structure of the sleeping bag illustrated in FIG. 1.

FIG. 3 is a sectional diagram schematically illustrating an example of an internal structure of the sleeping bag 1. As illustrated in FIG. 3, the sleeping bag 1 includes the lining 2 covering (wrapping) a user, the surface cloth 3 covering the lining 2, the batting 4 (a batting material, a heat insulating material) filled between the lining 2 and the surface cloth 3, and a plurality of chenille yarns (fancy yarns) 10 and 20 that prevent leaning of the batting 4.

The lining 2 and the surface cloth 3 are light and thin cloths made by weaving synthetic fibers or a nylon cloth made by weaving a nylon yarn of 7 deniers, for example. The cloths of the lining 2 and the surface cloth 3 may be given down-proof treatment so that the batting 4 does not burst out. The cloth of the surface cloth 3 may be given water-repelling treatment or may be a waterproof cloth so that the batting 4 does not get wet.

The lining 2 has a first surface 2A facing the user and a second surface 2B on a side opposite to the first surface 2A. The surface cloth 3 has a third surface 3A facing the lining 2 and a fourth surface 3B on a side opposite to the third surface 3A. The surface cloth 3 is faced with the lining 2 with an interval from the lining 2. The batting 4 is enclosed in a space sectioned between the second surface 2B of the lining 2 and the third surface 3A of the surface cloth 3.

An example of the batting 4 is down (feather). However, the batting 4 is not limited to down but may be synthetic fiber padding such as polyester fibers and the like or may be wool. The constitution disclosed in this description can be used for various types of the batting 4 as long as it is a fiber which is interlaced with the chenille yarns 10 and 20 so that movement is hindered. Each of the chenille yarns 10 includes a first core strand 11 extending in a first direction X while meandering and a plurality of first effect strands 12 extending irregularly in all directions from the first core strand 11.

Similarly, each of the chenille yarns 20 includes a second core strand 21 extending in a second direction Y while meandering and a plurality of second effect strands 22 extending in all directions from the second core strands 21. The first and second directions X and Y are both directions along the lining 2. Since the surface cloth 3 is substantially in parallel with the lining 2, the first and second directions X and Y are both also the directions following the surface cloth 3.

The first and second effect strands 12 and 22 extend three-dimensionally around the first and second core strands 11 and 21. The chenille yarns 10 and 20 accumulate air in the first and second effect strands 12 and 22 and bulky in a cloth thickness direction Z and thus, the loft of the sleeping bag 1 can be made larger. Moreover, the chenille yarns 10 and 20 extending three-dimensionally can hold a larger amount of the batting 4 than the non-woven cloth extending two-dimensionally.

By referring to FIG. 2, again, explanation will be made. In the illustrated example, the chenille yarns 10 extending in the first direction X while meandering are bundled in three pieces each so as to constitute a first linear member 10S. The first linear members 10S are aligned in plural at an interval of 50 mm each in the second direction Y crossing the extending direction. Similarly, the chenille yarns 20 extending in the second direction Y while meandering are bundled in three pieces each so as to constitute a second linear member 20S. The second linear members 20S are aligned in plural at an interval of 50 mm each in the first direction X crossing the extending direction.

In other words, the plurality of chenille yarns 10 are bundled in several yarns each in an aligned state, and each of the bundles is aligned at intervals. Similarly, the plurality of chenille yarns 20 are bundled in several yarns each in the aligned state, and each of the bundles is aligned at intervals. The direction of the chenille yarns 20 crosses the direction of the chenille yarns 10.

It is to be noted that the number of the chenille yarns 10 included in each of the first linear members 10S is not limited to three each but may be two or less or four or more. Similarly, the number of the chenille yarns 20 included in each of the second linear members 20S is not limited to three each. When any one of the chenille yarns 10 and 20 is cut off, the remaining chenille yarns 10 and 20 can hold the batting 4 and thus, the number of chenille yarns 10 and 20 included in each of the first linear members 10S and 20S is preferably two or more. The number of chenille yarns 10 and 20 included in each of the first linear members 10S and 20S can be increased/decreased as appropriate in accordance with the amount of the batting 4 to be enclosed.

In the illustrated example, the first direction X is a vertical direction when seen from the user, and the second direction Y is a lateral direction when seen from the user. However, the first and second directions X and Y are not limited to the illustrated example. The first direction X may be a diagonal direction up to the right when seen from the user, and the second direction Y may be a diagonal direction down to the right when seen from the user. Moreover, the extending direction of the chenille yarn is not limited to the two directions. For example, it may be so constituted that a third linear member (a bundle of chenille yarns bundled in several pieces each) crossing the first and second linear members 10S and 20S is added so that they extend in three directions rotated by 60 degrees each around an axis along a thickness direction Z of the cloth.

End portions of each of the chenille yarns 10 and 20, that is, the end portions of the aforementioned first and second core strands 11 and 12 are sewn and fixed to the lining 2. Though not shown, the end portions of each of the chenille yarns 10 and 20 may be fixed to the surface cloth 3. The aforementioned interval between the first and second linear members 10S and 20S is an interval between the end portions of the first and second linear members 10S and 20S sewn and fixed to the cloths 2 and 3, for example. If the chenille yarns 10 and 20 are extended on both the second surface 2B of the lining 2 and the third surface 3A of the surface cloth 3, the numbers of the chenille yarns 10 and 20 increase in the cloth thickness direction Z. The amount of the batting 4 that can be held increases, and the loft of the sleeping bag 1 becomes larger.

Figure 4:
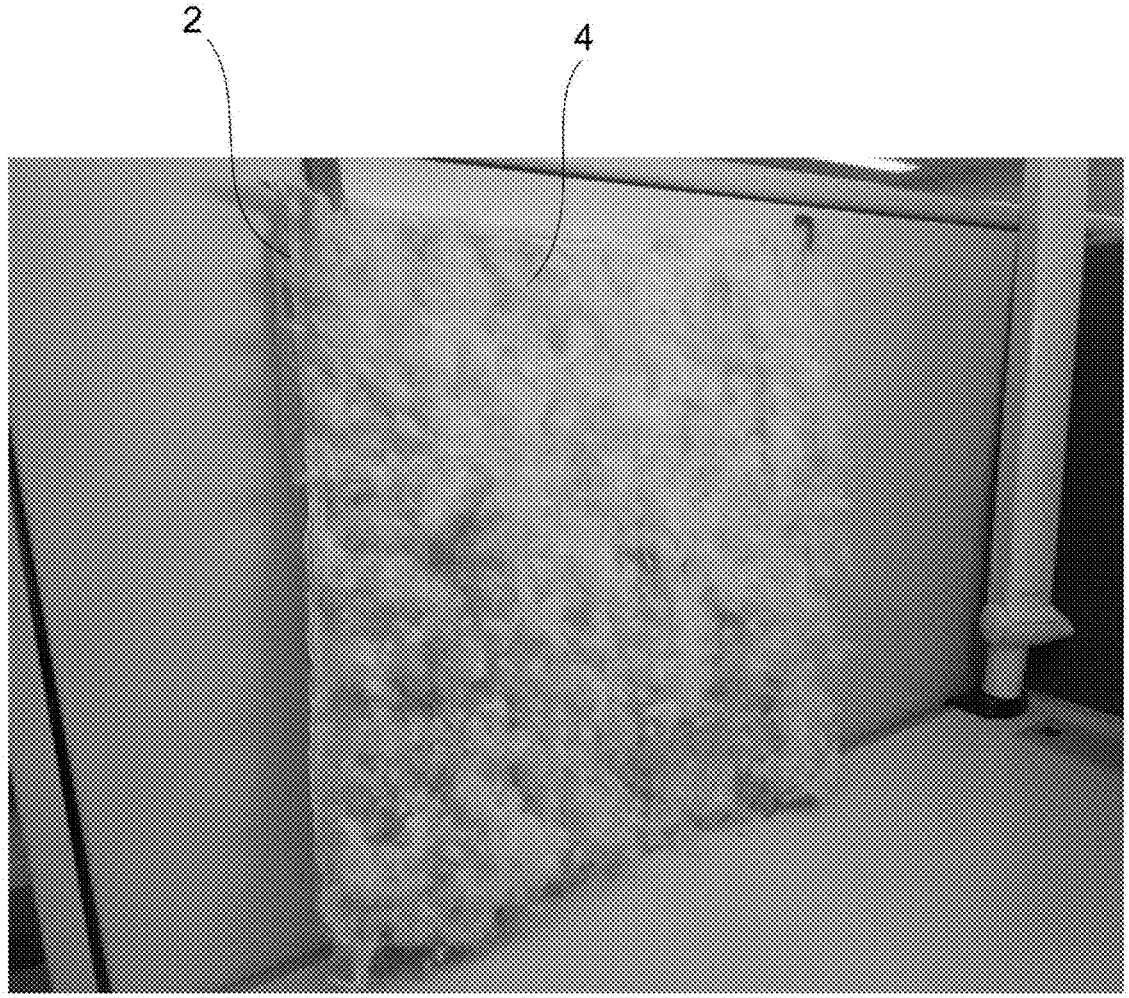
FIG. 4 is a view illustrating a state in which down is held by the sewn chenille yarns, and a lining is hung in a vertical direction.

FIG. 4 is a view illustrating a state in which the down is held by the sewn chenille yarns 10 and 20, and the lining 2 is hung in a vertical direction. In the illustrated example, the batting 4 is down with 800 fill power, and each of the first linear members 10S includes one chenille yarn 10, and each of the second linear members 20S includes one chenille yarn 20. The interval between the adjacent first and second linear members 10S and 20S is approximately 20 mm. It is to be noted that the interval between the adjacent first and second linear members 10S and 20S can be selected as appropriate in accordance with a type of the batting 4. In order to suitably hold the down or synthetic fiber padding used widely for the sleeping bag, the interval between the adjacent first linear members 10S is preferably 5 mm or more and 80 mm or less.

If the interval between the adjacent first linear members 10S is 5 mm or more, the batting 4 of 5 mm or less can be accommodated without crushing. The batting 4 is not only directly held by interlacing with the first effect strands 12 but is indirectly held by interlacing with the other batting 4 interlacing with the first effect strands 12. Thus, if the interval between the adjacent first linear members 10S is 80 mm or less, the ratio of the batting 4 which can be freely moved can be decreased so as to prevent leaning of the batting 4.

The sleeping bag 1 of this embodiment constituted as above includes the chenille yarns 10 and 20. According to the embodiment, as illustrated in FIG. 4, the leaning of the batting 4 can be prevented by the chenille yarns 10 and 20. Since a small thickness portion is hardly generated in the batting 4, heat insulation of the sleeping bag 1 is excellent. Even if the chenille yarns 10 and 20 are fixed to the cloth, the cloth does not become harder easily as compared with the case where the non-woven cloth is fixed. It can be stored in a compact manner as compared with the case where the non-woven cloth is superposed. Since the cushioning properties of the cloth are not lost, this embodiment is excellent in heat insulation and feeling on the skin. Since there is no need to sew the partition or to subdivide and fill the batting in each of the spaces between the partitions, productivity of the sleeping bag 1 is excellent.

In this embodiment, since the leaning of the batting 4 is prevented by the chenille yarns 10 and 20, the partition can be omitted. When the partition was to be sewn to the waterproof cloth, the seam needed to be closed by a seam tape so that water would not intrude through the seams. In this embodiment, since there is no need to attach the seam tape, the waterproof sleeping bag 1 can be constituted easily only by making the surface cloth 3 of a waterproof cloth.

In this embodiment, since the chenille yarns 10 and 20 with different extending directions are extended in all the directions in the lattice state, the leaning of the batting 4 can be prevented more reliably. Each of the chenille yarns 10 and 20 is fixed at two points on the both end portions. Since the number of seams can be minimized, the sleeping bag with excellent feeling on the skin can be constituted. It is to be noted that each of the chenille yarns 10 and 20 may be fixed at three points or more.

The embodiment described above is for facilitating understanding of the present invention and is not to be interpreted to limit the present invention. Each of the elements as well as arrangement, materials, conditions, shapes, sizes and the like thereof in the embodiment is not limited to those exemplified but may be changed as appropriate. Moreover, the constitutions illustrated in different embodiments can be partially replaced or combined.

REFERENCE SIGNS LIST

1 Sleeping bag (one example of cold-weather protection gear having batting)
2 Lining
3 Surface cloth
4 Batting
10, 20 Chenille yarn
10*s* First linear member
11 First core strand
12 First effect strand
20*s* Second linear member

21 Second core strand
22 Second effect strand
X First direction
Y Second direction
Z Thickness direction

What is claimed is:

1. A cold-weather protection gear having batting, comprising:

a lining that covers a user;

a surface cloth that covers the lining;

batting enclosed in a space between the lining and the surface cloth; and a plurality of first linear members located in the space between the lining and the surface cloth, the plurality of first linear members extending in a first direction and aligned with each other at an interval in a second direction crossing the first direction, wherein each of the first linear members includes:

at least one first core strand extending in the first direction; and a plurality of first effect strands extending from each of the first core strands and interlacing with the batting such that the batting is held in place relative to the first linear members by the first linear members; and wherein there are no partitions joining the lining and the surface cloth in the space enclosing the batting.

2. The cold-weather protection gear having batting according to claim 1, wherein both end portions of each of the first core strands are fixed to the lining or the surface cloth.

3. The cold-weather protection gear having batting according to claim 1, further comprising a plurality of second linear members located in the space between the lining and the surface cloth, the second linear members extending in the second direction and aligned at an interval in the first direction, wherein each of the second linear members includes:

at least one second core strand extending in the second direction; and a plurality of second effect strands extending from each of the second core strands and interlacing with the batting such that the batting is held in place relative to the first and second linear members by the first and second linear members.

4. The cold-weather protection gear having batting according to claim 1, wherein the surface cloth is a waterproof cloth.

5. The cold-weather protection gear having batting according to claim 2, further comprising a plurality of second linear members located in the space between the lining and the surface cloth, the second linear members extending in the second direction and aligned at an interval in the first direction, wherein each of the second linear members includes:

at least one second core strand extending in the second direction; and a plurality of second effect strands extending from each of the second core strands and interlacing with the batting such that the batting is held in place relative to the first and second linear members by the first and second linear members.

6. The cold-weather protection gear having batting according to claim 4, further comprising a plurality of second linear members located in the space between the lining and the surface cloth, the second linear members extending in the second direction and aligned at an interval in the first direction, wherein each of the second linear members includes:

at least one second core strand extending in the second direction; and a plurality of second effect strands extending from each of the second core strands and interlacing with the batting such that the batting is held in place relative to the first and second linear members by the first and second linear members.

7. The cold-weather protection gear having batting according to claim 2, wherein the surface cloth is a waterproof cloth.

8. The cold-weather protection gear having batting according to claim 5, wherein the surface cloth is a waterproof cloth.

9. The cold-weather protection gear having batting according to claim 1, wherein the at least one first core strand and the plurality of first effect strands of each of the first linear members comprises a chenille yarn.

10. The cold-weather protection gear having batting according to claim 3, wherein the at least one first core strand and the plurality of first effect strands of each of the first linear members, and the at least one second core strand and the plurality of second effect strands of each of the second linear members comprises a chenille yarn.

* * * * *